US008890440B2

(12) United States Patent
Yan et al.

(10) Patent No.: US 8,890,440 B2
(45) **Date of Patent: *Nov. 18, 2014**

(54) CIRCUITS AND METHODS FOR DRIVING LIGHT SOURCES

(71) Applicant: O2Micro, Inc., Santa Clara, CA (US)

(72) Inventors: Tiesheng Yan, Sichuan (CN); Youling Li, Shenzhen (CN); Feng Lin, Sichuan (CN); Xinhe Su, Sichuan (CN); Ching-Chuan Kuo, Taipei (TV)

(73) Assignee: O2Micro, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/970,287

(22) Filed: Aug. 19, 2013

(65) Prior Publication Data

US 2013/0328498 A1 Dec. 12, 2013

Related U.S. Application Data

(63) Continuation of application No. 13/556,690, filed on Jul. 24, 2012, now Pat. No. 8,664,895, which is a continuation of application No. 12/761,681, filed on Apr. 16, 2010, now Pat. No. 8,339,063.

(30) Foreign Application Priority Data

Mar. 4, 2010 (CN) ..... 2010 1 0119888

(51) Int. Cl.

| | |
|---|---|
| ***H05B 37/02*** | (2006.01) |
| ***H05B 39/04*** | (2006.01) |
| ***H05B 41/36*** | (2006.01) |
| ***G05F 1/00*** | (2006.01) |
| ***H05B 33/08*** | (2006.01) |

(52) U.S. Cl.

CPC ..... *H05B 37/02* (2013.01); *H05B 33/0815* (2013.01)

USPC ..... 315/307; 315/209 R; 315/291

(58) Field of Classification Search

None

See application file for complete search history.

(56) References Cited

U.S. PATENT DOCUMENTS 5,691,605 A 11/1997 Xia et al.
5,959,443 A 9/1999 Littlefield (Continued)

FOREIGN PATENT DOCUMENTS

CN 1498055 A 5/2004
CN 1694597 A 11/2005

(Continued)

OTHER PUBLICATIONS

The datasheet describes an Universal High Brightness LED driver HV9910B from Supertex, Inc.

(Continued)

*Primary Examiner* — Douglas W Owens
*Assistant Examiner* — Dedei K Hammond

(57) ABSTRACT

A controller for controlling power to a light source includes a first sensing pin, a second sensing pin, and a driving pin. The first sensing pin receives a first signal indicating an instant current through an energy storage element. The second sensing pin receives a second signal indicating whether the instant current decreases to a predetermined level. The driving pin provides a driving signal to a switch to control a current through the light source to a target level. The driving signal is generated based on one or more signals selected from the first signal and the second signal. The controller further includes an error amplifier for generating an error signal based on the first signal and a reference signal indicating the target level. The output of the error amplifier is coupled to a capacitor.

23 Claims, 8 Drawing Sheets

(56) References Cited

U.S. PATENT DOCUMENTS

| | | | |
|---|---|---|---|
| 6,304,464 | B1 | 10/2001 | Jacobs et al. |
| 6,320,330 | B1 | 11/2001 | Haavisto et al. |
| 6,727,662 | B2 | 4/2004 | Konopka et al. |
| 6,839,247 | B1 | 1/2005 | Yang et al. |
| 6,946,819 | B2 | 9/2005 | Fagnani et al. |
| 6,975,078 | B2 | 12/2005 | Yanai et al. |
| 6,984,963 | B2 | 1/2006 | Pidutti et al. |
| 7,084,582 | B2 | 8/2006 | Buonocunto |
| 7,141,940 | B2 | 11/2006 | Ortiz |
| 7,148,664 | B2 | 12/2006 | Takahashi et al. |
| 7,180,274 | B2 | 2/2007 | Chen et al. |
| 7,190,124 | B2 | 3/2007 | Kumar et al. |
| 7,259,527 | B2 | 8/2007 | Foo |
| 7,288,902 | B1 | 10/2007 | Melanson |
| 7,304,464 | B2 | 12/2007 | Weng et al. |
| 7,307,614 | B2 | 12/2007 | Vinn |
| 7,312,783 | B2 | 12/2007 | Oyama |
| 7,323,828 | B2 | 1/2008 | Russell et al. |
| 7,466,082 | B1 | 12/2008 | Snyder et al. |
| 7,639,517 | B2 | 12/2009 | Zhou et al. |
| 7,649,325 | B2 | 1/2010 | McIntosh et al. |
| 7,710,084 | B1 | 5/2010 | Guo |
| 7,714,464 | B2 | 5/2010 | Tsai et al. |
| 7,759,881 | B1 | 7/2010 | Melanson |
| 7,800,315 | B2 | 9/2010 | Shteynberg et al. |
| 7,804,256 | B2 | 9/2010 | Melanson |
| 7,852,017 | B1 | 12/2010 | Melanson |
| 7,863,828 | B2 | 1/2011 | Melanson |
| 7,888,922 | B2 | 2/2011 | Melanson |
| 7,944,153 | B2 | 5/2011 | Greenfeld |
| 8,076,867 | B2 | 12/2011 | Kuo et al. |
| 8,085,005 | B2 | 12/2011 | Dearn |
| 8,232,780 | B2 | 7/2012 | Uno |
| 8,274,800 | B2 | 9/2012 | Uno et al. |
| 8,344,657 | B2 | 1/2013 | Zhan et al. |
| 8,379,413 | B2 | 2/2013 | Ren et al. |
| 2001/0005319 | A1 | 6/2001 | Ohishi et al. |
| 2003/0048632 | A1 | 3/2003 | Archer |
| 2003/0107332 | A1 | 6/2003 | Newman, Jr. et al. |
| 2004/0085030 | A1 | 5/2004 | Laflamme et al. |
| 2004/0130271 | A1 | 7/2004 | Sekoguchi et al. |
| 2004/0218410 | A1 | 11/2004 | Yamada et al. |
| 2005/0017691 | A1 | 1/2005 | Aradachi et al. |
| 2006/0012997 | A1 | 1/2006 | Catalano et al. |
| 2006/0139907 | A1 | 6/2006 | Yen |
| 2007/0047276 | A1 | 3/2007 | Lin et al. |
| 2007/0182347 | A1 | 8/2007 | Shteynberg et al. |
| 2007/0262724 | A1 | 11/2007 | Mednik et al. |
| 2008/0030153 | A1 | 2/2008 | Mizuno |
| 2008/0180075 | A1 | 7/2008 | Xie et al. |
| 2008/0203946 | A1 | 8/2008 | Ito et al. |
| 2008/0224631 | A1 | 9/2008 | Melanson |
| 2008/0258641 | A1 | 10/2008 | Nakagawa et al. |
| 2008/0258647 | A1 | 10/2008 | Scianna |
| 2008/0259655 | A1 | 10/2008 | Wei et al. |
| 2008/0297068 | A1 | 12/2008 | Koren et al. |
| 2009/0167187 | A1 | 7/2009 | Kitagawa et al. |
| 2009/0184662 | A1 | 7/2009 | Given et al. |
| 2009/0189548 | A1 | 7/2009 | Hoffman et al. |
| 2009/0195180 | A1 | 8/2009 | Chenetz |
| 2009/0224686 | A1 | 9/2009 | Kunimatsu |
| 2009/0251059 | A1 | 10/2009 | Veltman |
| 2009/0251071 | A1 | 10/2009 | Gater et al. |
| 2009/0295303 | A1 | 12/2009 | Pucko et al. |
| 2009/0322254 | A1 | 12/2009 | Lin |
| 2009/0322255 | A1 | 12/2009 | Lin |
| 2010/0007292 | A1 | 1/2010 | Horino |
| 2010/0013409 | A1 | 1/2010 | Quek et al. |
| 2010/0026191 | A1 | 2/2010 | Radermacher et al. |
| 2010/0141177 | A1 | 6/2010 | Negrete et al. |
| 2010/0148681 | A1 | 6/2010 | Kuo et al. |
| 2010/0265745 | A1 | 10/2010 | Xu et al. |
| 2010/0308733 | A1* | 12/2010 | Shao ..... 315/119 |
| 2011/0001766 | A1 | 1/2011 | Hua et al. |
| 2011/0013437 | A1 | 1/2011 | Uruno et al. |
| 2011/0037399 | A1 | 2/2011 | Hung et al. |
| 2011/0050185 | A1* | 3/2011 | Notman et al. ..... 323/271 |
| 2011/0115407 | A1 | 5/2011 | Wibben et al. |
| 2011/0133665 | A1 | 6/2011 | Huang |
| 2011/0140630 | A1 | 6/2011 | Doudousakis et al. |
| 2012/0081018 | A1 | 4/2012 | Shteynberg et al. |
| 2012/0217894 | A1 | 8/2012 | Chang et al. |
| 2012/0242247 | A1 | 9/2012 | Hartmann et al. |
| 2012/0299502 | A1 | 11/2012 | Yan et al. |

FOREIGN PATENT DOCUMENTS

| | | | |
|---|---|---|---|
| CN | 1760721 | A | 4/2006 |
| CN | 101176386 | A | 5/2008 |
| CN | 101179879 | A | 5/2008 |
| CN | 101193486 | A | 6/2008 |
| CN | 101222800 | A | 7/2008 |
| CN | 101242143 | A | 8/2008 |
| CN | 101370335 | A | 2/2009 |
| CN | 101378207 | A | 3/2009 |
| CN | 101466186 | A | 6/2009 |
| CN | 101472368 | A | 7/2009 |
| CN | 101489335 | A | 7/2009 |
| CN | 101500354 | A | 8/2009 |
| CN | 101511136 | A | 8/2009 |
| CN | 101572974 | A | 11/2009 |
| CN | 101605413 | A | 12/2009 |
| CN | 101605416 | A | 12/2009 |
| CN | 101854759 | A | 10/2010 |
| CN | 102056378 | A | 5/2011 |
| CN | 102056378 | A | 5/2011 |
| DE | 29904988 | U1 | 6/1999 |
| EP | 1565042 | A2 | 8/2005 |
| EP | 2026634 | A1 | 2/2009 |
| EP | 2031942 | A2 | 3/2009 |
| EP | 2214457 | A1 | 8/2010 |
| EP | 2320710 | A1 | 5/2011 |
| JP | 10070846 | A | 3/1998 |
| JP | 2001185371 | A | 7/2001 |
| JP | 2001245436 | A | 9/2001 |
| JP | 2008210536 | A | 9/2008 |
| WO | 2006006085 | A1 | 1/2006 |
| WO | 2008001246 | A1 | 1/2008 |
| WO | 2010148329 | A1 | 12/2010 |
| WO | 2010150119 | A2 | 12/2010 |
| WO | 2011048214 | A1 | 4/2011 |
| WO | 2011048214 | A1 | 5/2011 |

OTHER PUBLICATIONS

GB Office Action dated Jan. 14, 2013 issued in related GB patent Application No. 1313787.2 (5 pages).

Datasheet of "Close Loop LED Driver with Enhanced PWM Dimming" from Supertex Inc, Dec. 31, 2009, pp. 1-12, XP002714011, CA, 94089, US.

Application report of"Driving High-Current LEDs" from Texas Instrument, Jan. 31, 2007, pp. 1-8, XP002714012.

The datasheet describes an Universal High Brightness LED driver HV9910B from Supertex, Inc. Sep. 2005, (12 pages).

The datasheet describes a PWM high efficiency LED driver controller A704 from ADDtek Corp., Aug. 2008.

European search report dated Oct. 4, 2013 issued in European Patent Application No. 12161538.9 (9 pages).

Japanese Office Action dated Oct. 15, 2013 issued in Japanese Patent Application 2010-258837 (3 pages).

Combined Search and Examination Report dated Jun. 26, 2014 issued for British Patent Application no. 1405042.1.

* cited by examiner

CIRCUITS AND METHODS FOR DRIVING LIGHT SOURCES

RELATED APPLICATION

This application is a continuation of the co-pending U.S. application Ser. No. 13/556,690, titled "Circuits and Methods for Driving Light Sources," filed on Jul. 24, 2012, which is a continuation of the co-pending U.S. application Ser. No. 12/761,681, titled "Circuits and Methods for Driving Light Sources," filed on Apr. 16, 2010, now U.S. Pat. No. 8,339,063, which itself claims priority to Chinese Patent Application No. 201010119888.2, titled "Circuits and Methods for Driving Light Sources," filed on Mar. 4, 2010 with the State Intellectual Property Office of the People's Republic of China.

BACKGROUND

FIG. 1 shows a block diagram of a conventional circuit 100 for driving a light source, e.g., a light emitting diode (LED) string 108. The circuit 100 is powered by a power source 102 which provides an input voltage VIN. The circuit 100 includes a buck converter for providing a regulated voltage VOUT to an LED string 108 under control of a controller 104. The buck converter includes a diode 114, an inductor 112, a capacitor 116, and a switch 106. A resistor 110 is coupled in series with the switch 106. When the switch 106 is turned on, the resistor 110 is coupled to the inductor 112 and the LED string 108, and can provide a feedback signal indicative of a current flowing through the inductor 112. When the switch 106 is turned off, the resistor 110 is disconnected from the inductor 112 and the LED string 108, and thus no current flows through the resistor 110.

The switch 106 is controlled by the controller 104. When the switch 106 is turned on, a current flows through the LED string 108, the inductor 112, the switch 106, and the resistor 110 to ground. The current increases due to the inductance of the inductor 112. When the current reaches a predetermined peak current level, the controller 104 turns off the switch 106. When the switch 106 is turned off, a current flows through the LED string 108, the inductor 112 and the diode 114. The controller 104 can turn on the switch 106 again after a time period. Thus, the controller 104 controls the buck converter based on the predetermined peak current level. However, the average level of the current flowing through the inductor 112 and the LED string 108 can vary with the inductance of the inductor 112, the input voltage VIN, and the voltage VOUT across the LED string 108. Therefore, the average level of the current flowing through the inductor 112 (the average current flowing through the LED string 108) may not be accurately controlled.

SUMMARY

In one embodiment, a controller for controlling power to a light source includes a first sensing pin, a second sensing pin, a third sensing pin, and a driving pin. The first sensing pin receives a first signal indicating an instant current flowing through an energy storage element. The second sensing pin receives a second signal indicating an average current flowing through the energy storage element. The third sensing pin receives a third signal indicating whether the instant current decreases to a predetermined current level. The driving pin provides a driving signal to a switch to control an average current flowing through the light source to a target current level. The driving signal is generated based on one or more signals selected from the first signal, the second signal and the third signal.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Embodiments in accordance with the present invention provide circuits and methods for controlling power converters that can be used to power various types of loads, for example, a light source. The circuit can include a current sensor operable for monitoring a current flowing through an energy storage element, e.g., an inductor, and include a controller operable for controlling a switch coupled to the inductor so as to control an average current of the light source to a target current. The current sensor can monitor the current through the inductor when the switch is on and also when the switch is off.

Figure 2:
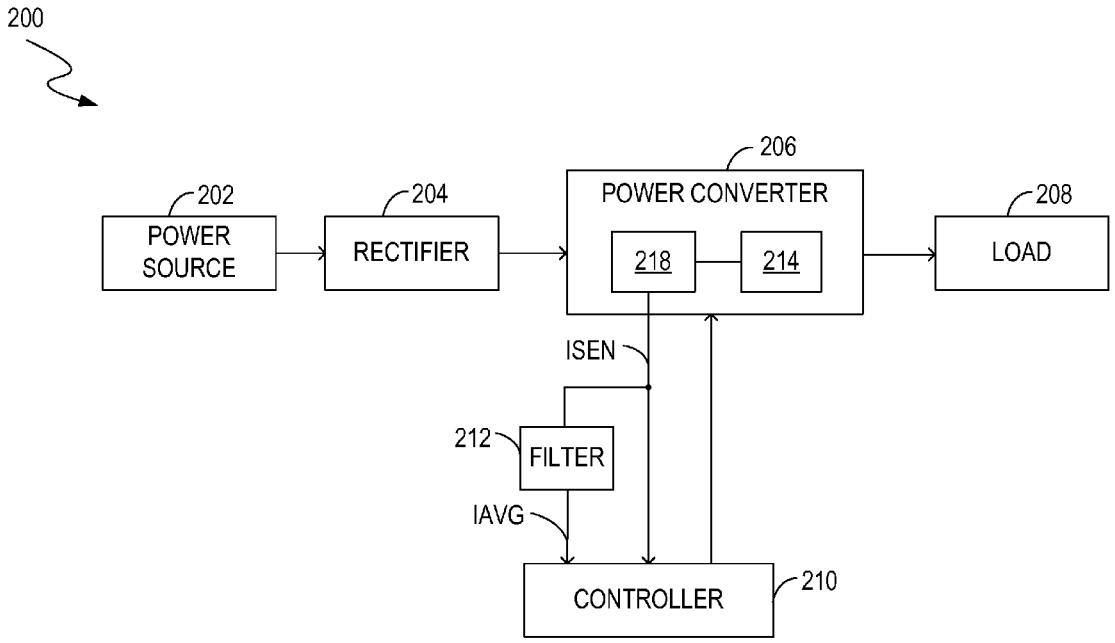
FIG. 2 shows a block diagram of a driving circuit, in accordance with one embodiment of the present invention.

FIG. 2 shows a block diagram of a driving circuit 200, in accordance with one embodiment of the present invention. The driving circuit 200 includes a rectifier 204 which receives an input voltage from a power source 202 and provides a rectified voltage to a power converter 206. The power converter 206, receiving the rectified voltage, provides output power for a load 208. The power converter 206 can be a buck converter or a boost converter. In one embodiment, the power converter 206 includes an energy storage element 214 and a current sensor 218 for sensing an electrical condition of the energy storage element 214. The current sensor 218 provides a first signal ISEN to a controller 210, which indicates an instant current flowing through the energy storage element 214. The driving circuit 200 can further include a filter 212 operable for generating a second signal IAVG based on the first signal ISEN, which indicates an average current flowing through the energy storage element 214. The controller 210 receives the first signal ISEN and the second signal IAVG, and controls the average current flowing through the energy storage element 214 to a target current level, in one embodiment.

Figure 3:
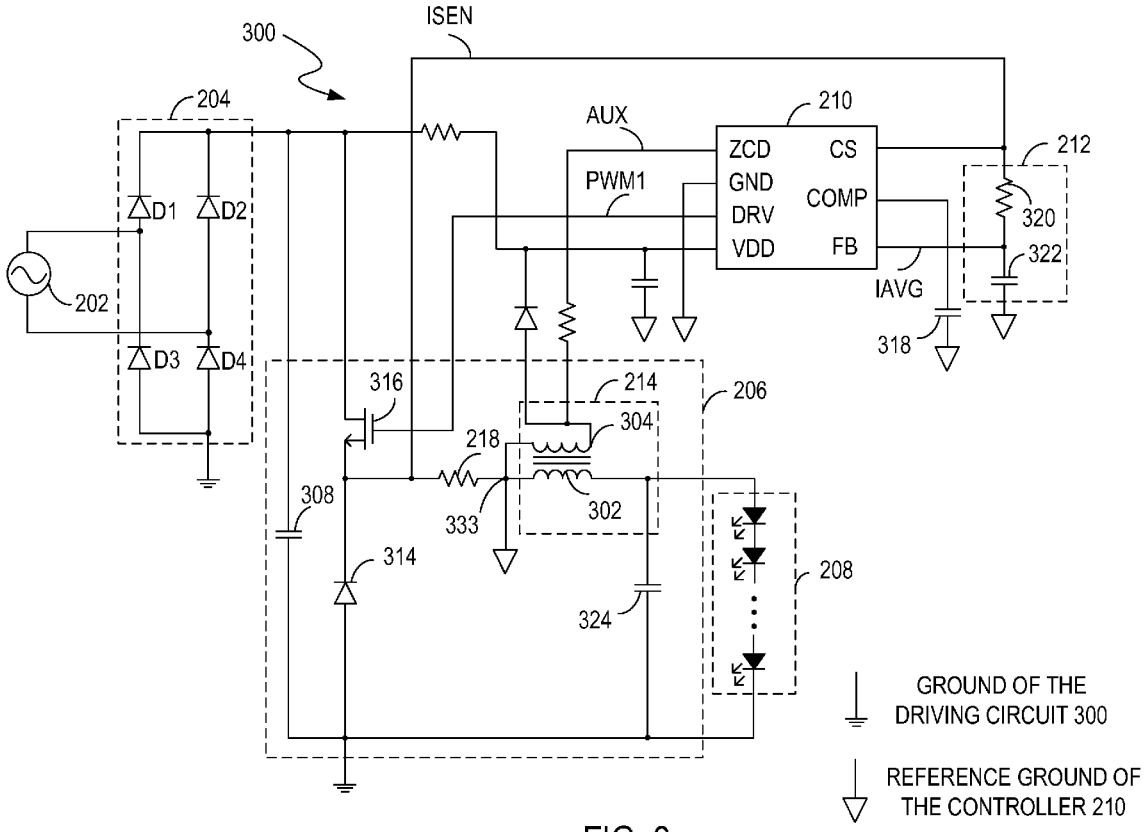
FIG. 3 shows an example for a schematic diagram of a driving circuit, in accordance with one embodiment of the present invention.

FIG. 3 shows an example for a schematic diagram of a driving circuit 300, in accordance with one embodiment of the present invention. Elements labeled the same as in FIG. 2 have similar functions. In the example of FIG. 3, the driving circuit 300 includes a rectifier 204, a power converter 206, a filter 212, and a controller 210. By way of example, the rectifier 204 is a bridge rectifier which includes diodes D1~D4. The rectifier 204 rectifies the voltage from the power source 202. The power converter 206 receives the rectified voltage from the rectifier 204 and provides output power for powering a load, e.g., an LED string 208.

In the example of FIG. 3, the power converter 206 is a buck converter including a capacitor 308, a switch 316, a diode 314, a current sensor 218 (e.g., a resistor), coupled inductors 302 and 304, and a capacitor 324. The diode 314 is coupled between the switch 316 and ground of the driving circuit 300. The capacitor 324 is coupled in parallel with the LED string 208. In one embodiment, the inductors 302 and 304 are both electrically and magnetically coupled together. More specifically, the inductor 302 and the inductor 304 are electrically coupled to a common node 333. In the example of FIG. 3, the common node 333 is between the resistor 218 and the inductor 302. However, the invention is not so limited; the common node 333 can also locate between the switch 316 and the resistor 218. The common node 333 provides a reference ground for the controller 210. The reference ground of the controller 210 is different from the ground of the driving circuit 300, in one embodiment. By turning the switch 316 on and off, a current flowing through the inductor 302 can be adjusted, thereby adjusting the power provided to the LED string 208. The inductor 304 senses an electrical condition of the inductor 302, for example, whether the current flowing through the inductor 302 decreases to a predetermined current level.

The resistor 218 has one end coupled to a node between the switch 316 and the cathode of the diode 314, and the other end coupled to the inductor 302. The resistor 218 provides a first signal ISEN indicating an instant current flowing through the inductor 302 when the switch 316 is on and also when the switch 316 is off. In other words, the resistor 218 can sense the instant current flowing through the inductor 302 regardless of whether the switch 316 is on or off. The filter 212 coupled to the resistor 218 generates a second signal IAVG indicating an average current flowing through the inductor 302. In one embodiment, the filter 212 includes a resistor 320 and a capacitor 322.

The controller 210 receives the first signal ISEN and the second signal IAVG, and controls an average current flowing through the inductor 302 to a target current level by turning the switch 316 on and off. A capacitor 324 absorbs ripple current flowing through the LED string 208 such that the current flowing through the LED string 208 is smoothed and substantially equal to the average current flowing through the inductor 302. As such, the current flowing through the LED string 208 can have a level that is substantially equal to the target current level. As used herein, "substantially equal to the target current level" means that the current flowing through the LED string 208 may be slightly different from the target current level but within a range such that the current ripple caused by the non-ideality of the circuit components can be neglected and the power transferred from the inductor 304 to the controller 210 can be neglected.

In the example of FIG. 3, the controller 210 has terminals ZCD, GND, DRV, VDD, CS, COMP and FB. The terminal ZCD is coupled to the inductor 304 for receiving a detection signal AUX indicating an electrical condition of the inductor 302, for example, whether the current flowing through the inductor 302 decreases to a predetermined current level, e.g., zero. The signal AUX can also indicate whether the LED string 208 is in an open circuit condition. The terminal DRV is coupled to the switch 316 and generates a driving signal, e.g., a pulse-width modulation signal PWM1, to turn the switch 316 on and off. The terminal VDD is coupled to the inductor 304 for receiving power from the inductor 304. The terminal CS is coupled to the resistor 218 and is operable for receiving the first signal ISEN indicating an instant current flowing through the inductor 302. The terminal COMP is coupled to the reference ground of the controller 210 through a capacitor 318. The terminal FB is coupled to the resistor 218 through the filter 212 and is operable for receiving the second signal IAVG which indicates an average current flowing through the inductor 302. In the example of FIG. 3, the terminal GND, that is, the reference ground for the controller 210, is coupled to the common node 333 between the resistor 218, the inductor 302, and the inductor 304.

The switch 316 can be an N channel metal oxide semiconductor field effect transistor (NMOSFET). The conductance status of the switch 316 is determined based on a difference between the gate voltage of the switch 316 and the voltage at the terminal GND (the voltage at the common node 333). Therefore, the switch 316 is turned on and turned off depending upon the pulse-width modulation signal PWM1 from the terminal DRV. When the switch 316 is on, the reference ground of the controller 210 is higher than the ground of the driving circuit 300, making the invention suitable for power sources having relatively high voltages.

In operation, when the switch 316 is turned on, a current flows through the switch 316, the resistor 218, the inductor 302, the LED string 208 to the ground of the driving circuit 300. When the switch 316 is turned off, a current continues to flow through the resistor 218, the inductor 302, the LED string 208 and the diode 314. The inductor 304 magnetically coupled to the inductor 302 detects an electrical condition of the inductor 302, for example, whether the current flowing through the inductor 302 decreases to a predetermined current level. Therefore, the controller 210 monitors the current flowing through the inductor 302 through the signal AUX, the signal ISEN, and the signal IAVG, and control the switch 316 by a pulse-width modulation signal PWM1 so as to control an average current flowing through the inductor 302 to a target current level, in one embodiment. As such, the current flowing through the LED string 208, which is filtered by the capacitor 324, can also be substantially equal to the target current level.

In one embodiment, the controller 210 determines whether the LED string 208 is in an open circuit condition based on the signal AUX. If the LED string 208 is open, the voltage across the capacitor 324 increases. When the switch 316 is off, the voltage across the inductor 302 increases and the voltage of the signal AUX increases accordingly. As a result, the current flowing through the terminal ZCD into the controller 210 increases. Therefore, the controller 210 monitors the signal AUX and if the current flowing into the controller 210 increases above a current threshold when the switch 316 is off, the controller 210 determines that the LED string 208 is in an open circuit condition.

The controller 210 can also determine whether the LED string 208 is in a short circuit condition based on the voltage at the terminal VDD. If the LED string 208 is in a short circuit condition, when the switch 316 is off, the voltage across the inductor 302 decreases because both terminals of the inductor 302 are coupled to ground of the driving circuit 300. If the voltage at the terminal VDD decreases below a voltage threshold when the switch 316 is off, the controller 210 determines that the LED string 208 is in a short circuit condition.

Figure 4:
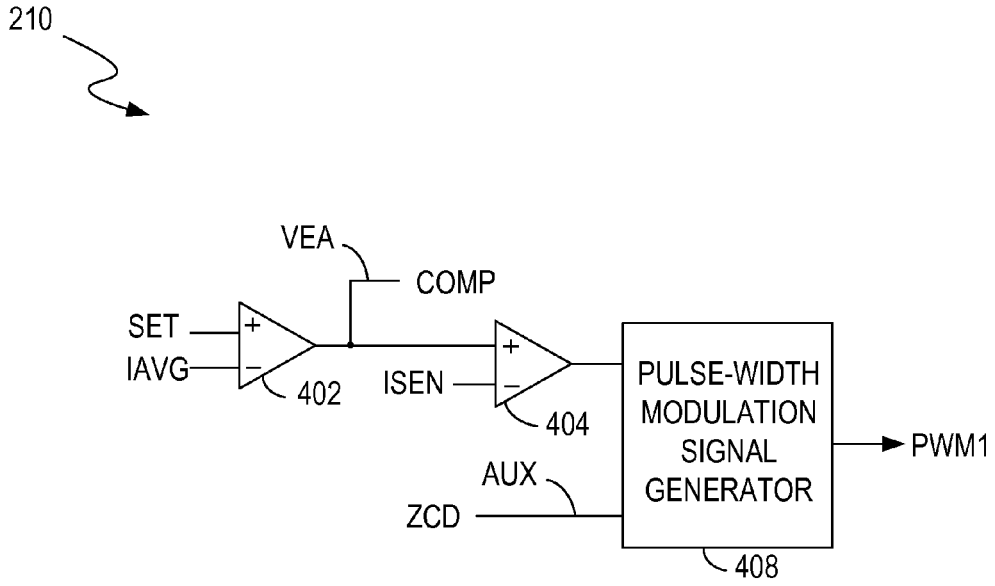
FIG. 4 shows an example of the controller in FIG. 3, in accordance with one embodiment of the present invention.
Figure 5:
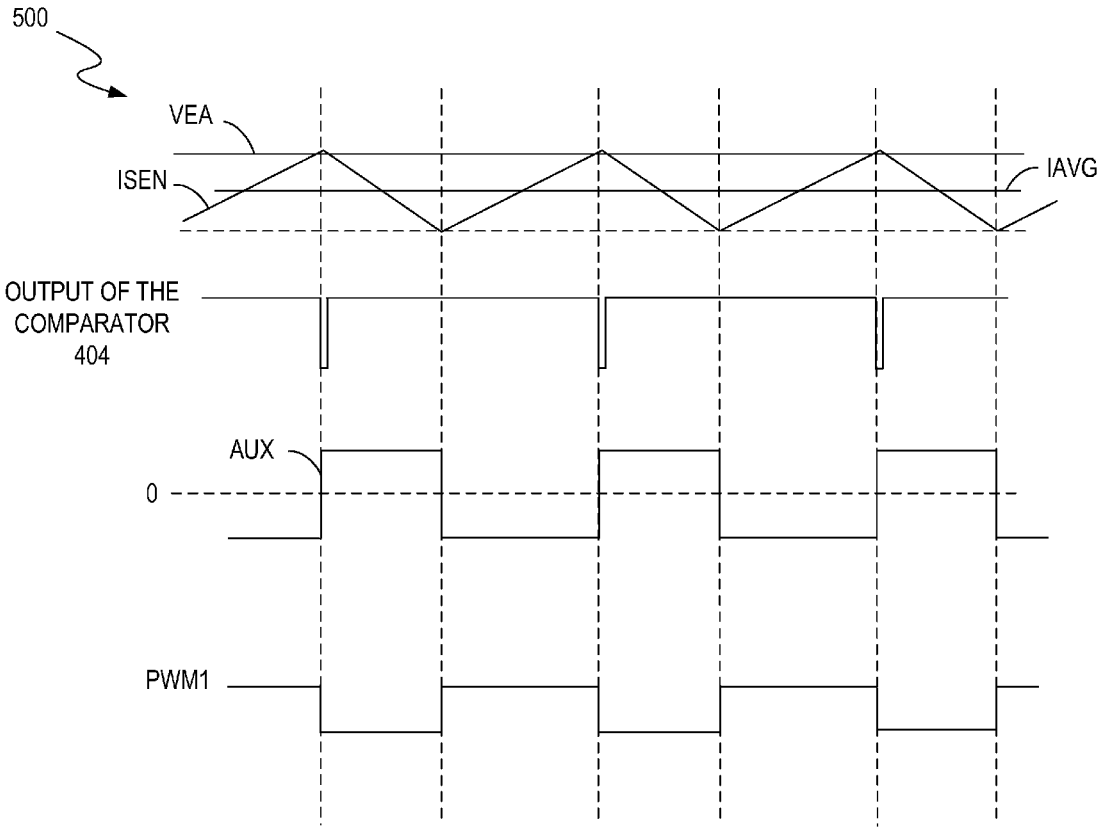
FIG. 5 shows signal waveforms of signals associated with a controller in FIG. 4, in accordance with one embodiment of the present invention.

FIG. 4 shows an example of the controller 210 in FIG. 3, in accordance with one embodiment of the present invention. FIG. 5 shows signal waveforms of signals associated with the controller 210 in FIG. 4, in accordance with one embodiment of the present invention. FIG. 4 is described in combination with FIG. 3 and FIG. 5.

In the example of FIG. 4, the controller 210 includes an error amplifier 402, a comparator 404, and a pulse-width modulation signal generator 408. The error amplifier 402 generates an error signal VEA based on a difference between a reference signal SET and the signal IAVG. The reference signal SET can indicate a target current level. The signal IAVG is received at the terminal FB and can indicate an average current flowing through the inductor 302. The error signal VEA can be used to adjust the average current flowing through the inductor 302 to the target current level. The comparator 404 is coupled to the error amplifier 402 and compares the error signal VEA with the signal ISEN. The signal ISEN is received at the terminal CS and indicates an instant current flowing through the inductor 302. The signal AUX is received at the terminal ZCD and indicates whether the current flowing through the inductor 302 decreases to a predetermined current level, e.g., zero. The pulse-width modulation signal generator 408 is coupled to the comparator 404 and the terminal ZCD, and can generate a pulse-width modulation signal PWM1 based on an output of the comparator 404 and the signal AUX. The pulse-width modulation signal PWM1 is applied to the switch 316 via the terminal DRV to control a conductance status of the switch 316.

In operation, the pulse-width modulation signal generator 408 can generate the pulse-width modulation signal PWM1 having a first level (e.g., logic 1) to turn on the switch 316. When the switch 316 is turned on, a current flows through the switch 316, the resistor 218, the inductor 302, the LED string 208 to the ground of the driving circuit 300. The current flowing through the inductor 302 increases such that the voltage of the signal ISEN increases. The signal AUX has a negative voltage level when the switch 316 is turned on, in one embodiment. In the controller 210, the comparator 404 compares the error signal VEA with the signal ISEN. When the voltage of the signal ISEN increases above the voltage of the error signal VEA, the output of the comparator 404 is logic 0, otherwise the output of the comparator 404 is logic 1, in one embodiment. In other words, the output of the comparator 404 includes a series of pulses. The pulse-width modulation signal generator 408 generates the pulse-width modulation signal PWM1 having a second level (e.g., logic 0) in response to a negative-going edge of the output of the comparator 404 to turn off the switch 316. The voltage of the signal AUX changes to a positive voltage level when the switch 316 is turned off. When the switch 316 is turned off, a current flows through the resistor 218, the inductor 302, the LED string 208 and the diode 314. The current flowing through the inductor 302 decreases such that the voltage of the signal ISEN decreases. When the current flowing through the inductor 302 decreases to a predetermined current level (e.g., zero), a negative-going edge occurs to the voltage of the signal AUX. Receiving a negative-going edge of the signal AUX, the pulse-width modulation signal generator 408 generates the pulse-width modulation signal PWM1 having the first level (e.g., logic 1) to turn on the switch 316.

In one embodiment, a duty cycle of the pulse-width modulation signal PWM1 is determined by the error signal VEA. If the voltage of the signal IAVG is less than the voltage of the signal SET, the error amplifier 402 increases the voltage of the error signal VEA so as to increase the duty cycle of the pulse-width modulation signal PWM1. Accordingly, the average current flowing through the inductor 302 increases until the voltage of the signal IAVG reaches the voltage of the signal SET. If the voltage of the signal IAVG is greater than the voltage of the signal SET, the error amplifier 402 decreases the voltage of the error signal VEA so as to decrease the duty cycle of the pulse-width modulation signal PWM1. Accordingly, the average current flowing through the inductor 302 decreases until the voltage of the signal IAVG drops to the voltage of the signal SET. As such, the average current flowing through the inductor 302 can be maintained to be substantially equal to the target current level.

Figure 6:
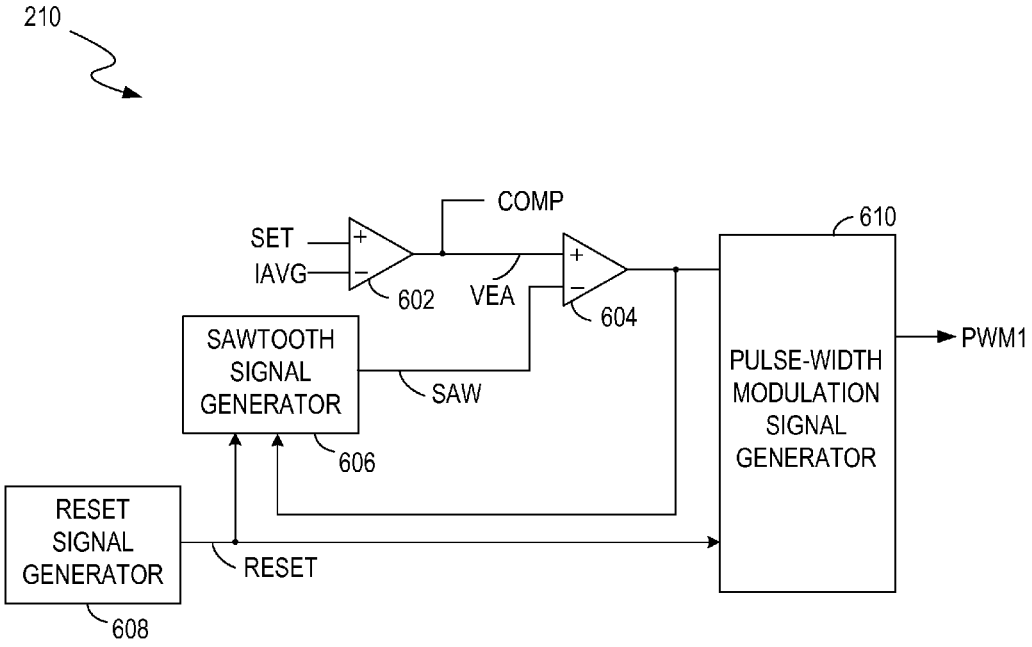
FIG. 6 shows another example of the controller in FIG. 3, in accordance with one embodiment of the present invention.
Figure 7:
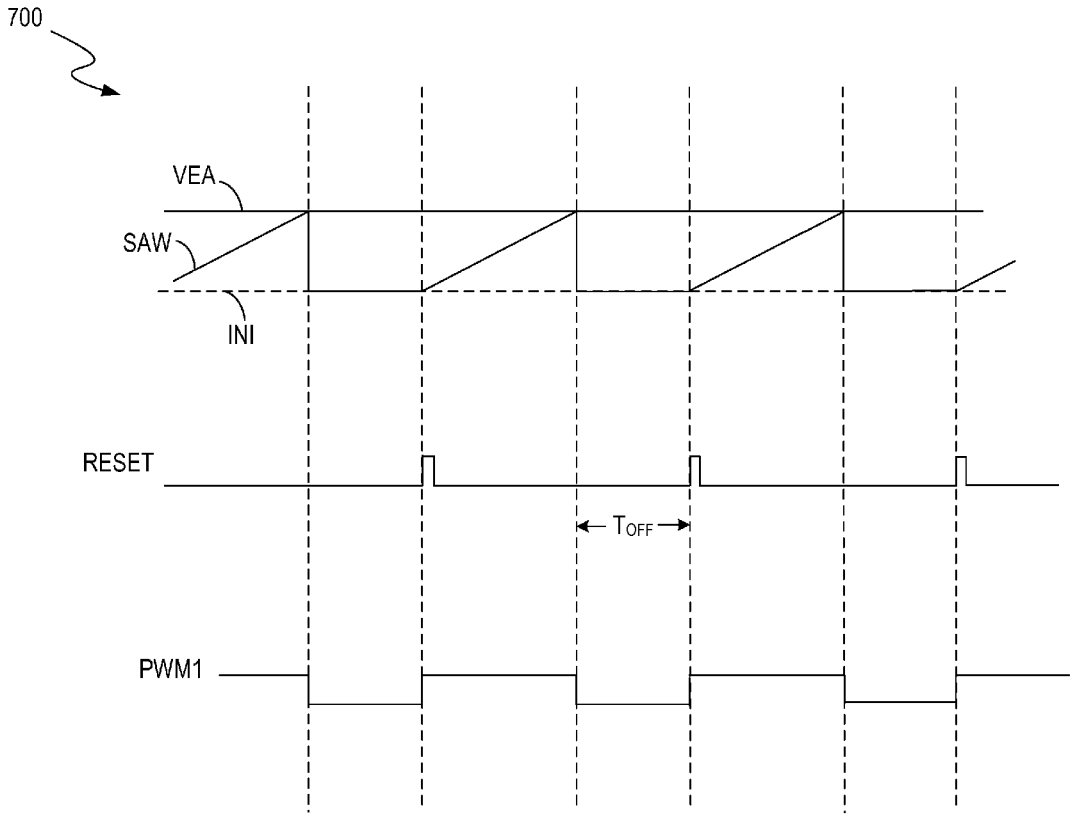
FIG. 7 shows signal waveforms of signals associated with a controller in FIG. 6, in accordance with one embodiment of the present invention.

FIG. 6 shows another example of the controller 210 in FIG. 3, in accordance with one embodiment of the present invention. FIG. 7 shows waveforms of signals associated with the controller 210 in FIG. 6, in accordance with one embodiment of the present invention. FIG. 6 is described in combination with FIG. 3 and FIG. 7.

In the example of FIG. 6, the controller 210 includes an error amplifier 602, a comparator 604, a sawtooth signal generator 606, a reset signal generator 608, and a pulse-width modulation signal generator 610. The error amplifier 602 generates an error signal VEA based on a reference signal SET and the signal IAVG. The reference signal SET indicates a target current level. The signal IAVG is received at the terminal FB and indicates an average current flowing through the inductor 302. The error signal VEA is used to adjust the average current flowing through the inductor 302 to the target current level. The sawtooth signal generator 606 generates a sawtooth signal SAW. The comparator 604 is coupled to the error amplifier 602 and the sawtooth signal generator 606, and compares the error signal VEA with the sawtooth signal SAW. The reset signal generator 608 generates a reset signal RESET which is applied to the sawtooth signal generator 606 and the pulse-width modulation signal generator 610. The switch 316 can be turned on in response to the reset signal RESET. The pulse-width modulation signal generator 610 is coupled to the comparator 604 and the reset signal generator 608, and generates a pulse-width modulation (PWM) signal PWM1 based on an output of the comparator 604 and the reset signal RESET. The pulse-width modulation signal PWM1 is applied to the switch 316 via the terminal DRV to control a conductance status of the switch 316.

In one embodiment, the reset signal RESET is a pulse signal having a constant frequency. In another embodiment, the reset signal RESET is a pulse signal configured in a way such that a time period Toff during which the switch 316 is off is constant. For example, in FIG. 5, the time period during which the pulse-width modulation signal PWM1 is logic 0 can be constant.

In operation, the pulse-width modulation signal generator 610 generates the pulse-width modulation signal PWM1 having a first level (e.g., logic 1) to turn on the switch 316 in response to a pulse of the reset signal RESET. When the switch 316 is turned on, a current flows through the switch 316, the resistor 218, the inductor 302, the LED string 208 to the ground of the driving circuit 300. The sawtooth signal SAW generated by the sawtooth signal generator 606 starts to increase from an initial level INI in response to a pulse of the reset signal RESET. When the voltage of the sawtooth signal SAW increases to the voltage of the error signal VEA, the pulse-width modulation signal generator 610 generates the pulse-width modulation signal PWM1 having a second level (e.g., logic 0) to turn off the switch 316. The sawtooth signal SAW is reset to the initial level INI until a next pulse of the reset signal RESET is received by the sawtooth signal generator 606. The sawtooth signal SAW starts to increase from the initial level INI again in response to the next pulse.

In one embodiment, a duty cycle of the pulse-width modulation signal PWM1 is determined by the error signal VEA. If the voltage of the signal IAVG is less than the voltage of the signal SET, the error amplifier 602 increases the voltage of the error signal VEA so as to increase the duty cycle of the pulse-width modulation signal PWM1. Accordingly, the average current flowing through the inductor 302 increases until the voltage of the signal IAVG reaches the voltage of the signal SET. If the voltage of the signal IAVG is greater than the voltage of the signal SET, the error amplifier 602 decreases the voltage of the error signal VEA so as to decrease the duty cycle of the pulse-width modulation signal PWM1. Accordingly, the average current flowing through the inductor 302 decreases until the voltage of the signal IAVG drops to the voltage of the signal SET. As such, the average current flowing through the inductor 302 can be maintained to be substantially equal to the target current level.

Figure 8:
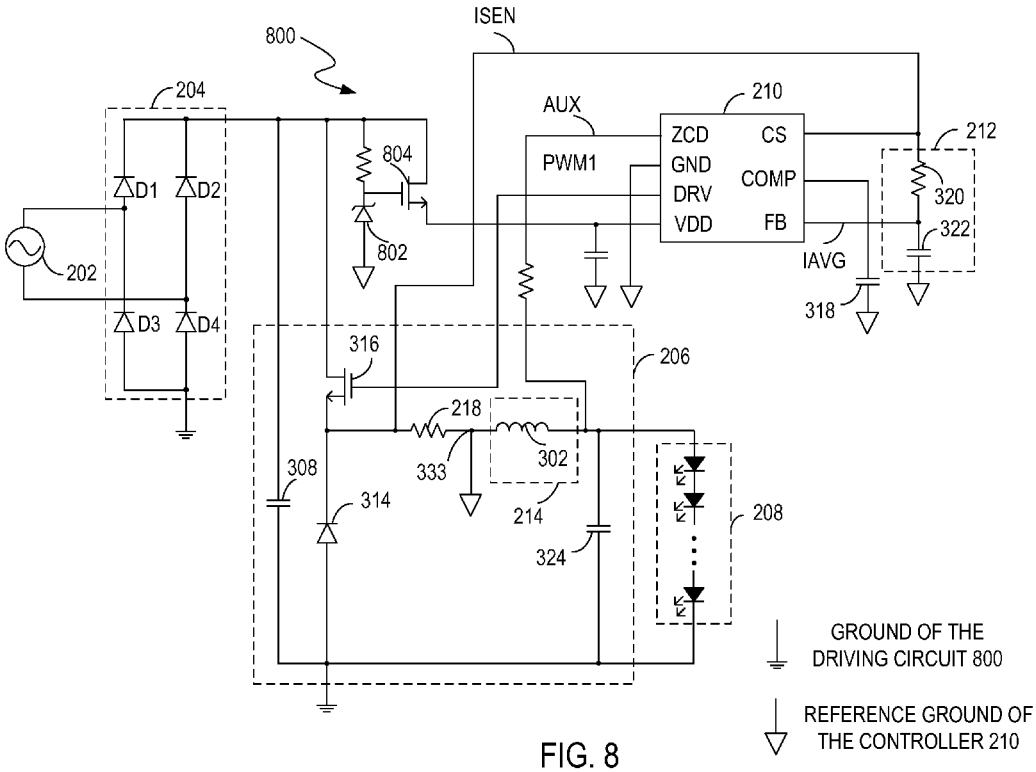
FIG. 8 shows another example for a schematic diagram of a driving circuit, in accordance with one embodiment of the present invention.

FIG. 8 shows another example for a schematic diagram of a driving circuit 800, in accordance with one embodiment of the present invention. Elements labeled the same as in FIG. 2 and FIG. 3 have similar functions.

The terminal VDD of the controller 210 is coupled to the rectifier 204 through a switch 804 for receiving the rectified voltage from the rectifier 204. A Zener diode 802 is coupled between the switch 804 and the reference ground of the controller 210, and maintains the voltage at the terminal VDD at a substantially constant level. In the example of FIG. 8, the terminal ZCD of the controller 210 is electrically coupled to the inductor 302 for receiving a signal AUX indicating an electrical condition of the inductor 302, e.g., whether the current flowing through the inductor 302 decreases to a predetermined current level, e.g., zero. The node 333 can provide the reference ground for the controller 210.

Figure 1:
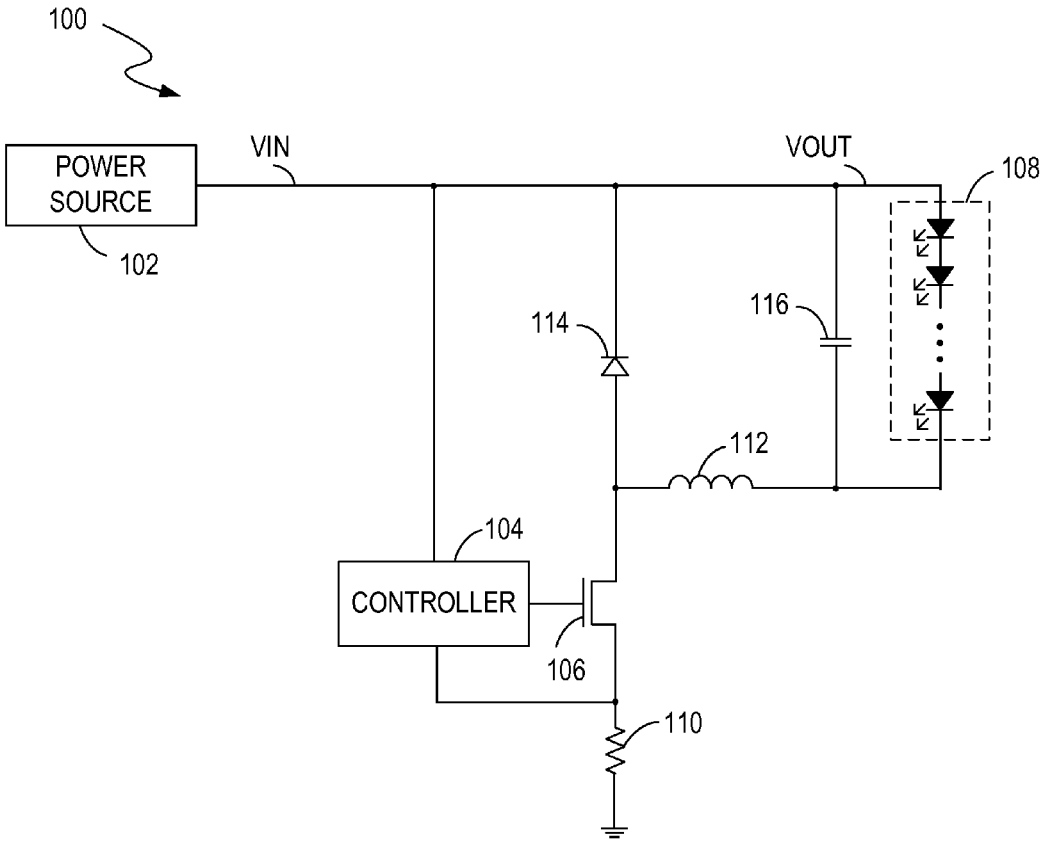
FIG. 1 PRIOR ART
FIG. 1 shows a block diagram of a conventional circuit for driving a light source.

Accordingly, embodiments in accordance with the present invention provide circuits and methods for controlling a power converter that can be used to power various types of loads. In one embodiment, the power converter provides a substantially constant current to power a load such as a light emitting diode (LED) string. In another embodiment, the power converter provides a substantially constant current to charge a battery. Advantageously, compared with the conventional driving circuit in FIG. 1, the average current to the load or the battery can be controlled more accurately. Furthermore, the circuits according to present invention can be suitable for power sources having relatively high voltages.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A controller for controlling power to a light source, said controller comprising:

a first sensing pin operable for receiving a first signal indicating an instant current flowing through an energy storage element;

a second sensing pin operable for receiving a second signal indicating whether said instant current decreases to a predetermined current level;

a driving pin operable for providing a driving signal to a switch to control a current flowing through said light source to a target current level, wherein said driving signal is generated based on one or more signals selected from said first signal and said second signal;

an error amplifier operable for generating an error signal based on said first signal and also based on a reference signal indicating said target current level, wherein the output of said error amplifier is coupled to a capacitor, and a power pin operable for receiving a voltage to power said controller, wherein said controller determines whether said light source is in a short circuit condition according to said voltage.

2. The controller as claimed in claim 1, further comprising:

a comparator coupled to said error amplifier and operable for comparing said error signal and said first signal.

3. The controller as claimed in claim 2, further comprising:

a pulse-width modulation signal generator coupled to said comparator and operable for generating said driving signal based on an output of said comparator and also based on said second signal.

4. The controller as claimed in claim 1, further comprising:

a comparator coupled to said error amplifier and operable for comparing said error signal with a sawtooth signal.

5. The controller as claimed in claim 4, further comprising:

a pulse-width modulation signal generator coupled to said comparator and operable for generating said driving signal based on an output of said comparator and also based on a reset signal.

6. The controller as claimed in claim 5, wherein said reset signal comprises a pulse signal having a constant frequency.

7. The controller as claimed in claim 5, wherein said driving signal comprises a pulse-width modulation signal having a first state and a second state, and wherein said reset signal comprises a pulse signal configured so that a time period during which said driving signal is in said second state is constant.

8. The controller as claimed in claim 1, wherein said controller determines whether said light source is in an open circuit condition according to said second signal.

9. The controller as claimed in claim 8, wherein said controller determines that said light source is in said open circuit condition if said second signal increases above a threshold when said switch is off.

10. The controller as claimed in claim 1, wherein said controller determines that said light source is in said short circuit condition if said voltage decreases below a threshold when said switch is off.

11. A circuit for driving a light source, said circuit comprising:

a power converter comprising a switch and an energy storage element coupled to said light source, wherein said switch is turned on and off alternately according to a driving signal to control a current flowing through said light source to a target current level; and a controller coupled to said power converter, said controller comprising:

a first sensing pin operable for receiving a first signal indicating an instant current flowing through said energy storage element;

a second sensing pin operable for receiving a second signal indicating whether said instant current decreases to a predetermined current level;

a driving pin operable for providing said driving signal to said switch, wherein said driving signal is generated based on one or more signals selected from said first signal and said second signal; and an error amplifier operable for generating an error signal based on said first signal and also based on a reference signal indicating said target current level, wherein the output of said error amplifier is coupled to a capacitor, wherein said power converter comprises a sensor for providing said first signal, wherein a common node between said sensor and said energy storage element provides a reference ground for said controller.

12. The circuit as claimed in claim 11, wherein said energy storage element comprises an inductor operable for generating said second signal.

13. The circuit as claimed in claim 11, wherein said controller further comprises:

a comparator coupled to said error amplifier and operable for comparing said error signal and said first signal; and a pulse-width modulation signal generator coupled to said comparator and operable for generating said driving signal based on an output of said comparator and also based on said second signal.

14. The circuit as claimed in claim 11, wherein said driving signal comprises a pulse-width modulation signal having a first level and a second level, wherein said driving signal has said first level to turn on said switch when said second signal indicates that said instant current decreases to said predetermined current level, and wherein said driving signal has said second level to turn off said switch when a voltage of said first signal increases to a voltage of said error signal.

15. The circuit as claimed in claim 11, wherein said controller further comprises:

a comparator coupled to said error amplifier and operable for comparing said error signal with a sawtooth signal; and a pulse-width modulation signal generator coupled to said comparator and operable for generating said driving signal based on an output of said comparator and also based on a reset signal.

16. The circuit as claimed in claim 15, wherein said driving signal comprises a pulse-width modulation signal having a first level and a second level, and wherein said driving signal has said first level to turn on said switch in response to said reset signal, and has said second level to turn off said switch when a voltage of said sawtooth signal increases to a voltage of said error signal.

17. The circuit as claimed in claim 16, wherein said reset signal comprises a pulse signal configured to have a constant time period during which said pulse-width modulation signal is in said second state.

18. The circuit as claimed in claim 15, wherein said reset signal comprises a pulse signal having a constant frequency.

19. The circuit as claimed in claim 11, wherein said controller determines that said light source is in an open circuit condition if said second signal increases above a threshold when said switch is off.

20. The circuit as claimed in claim 11, wherein said controller further comprises:

a power pin operable for receiving a voltage to power said controller, wherein said controller determines that said light source is in a short circuit condition if said voltage decreases below a threshold when said switch is off.

21. A controller for controlling power to a light source, said controller comprising:

a first sensing pin operable for receiving a first signal indicating an average current flowing through an energy storage element;

a second sensing pin operable for receiving a second signal indicating whether an instant current flowing through said energy storage element decreases to a predetermined current level;

a driving pin operable for providing a driving signal to a switch to control a current flowing through said light source to a target current level, wherein said driving signal is generated based on one or more signals selected from said first signal and said second signal;

an error amplifier operable for generating an error signal based on said first signal and also based on a reference signal indicating said target current level, wherein the output of said error amplifier is coupled to a capacitor; and a power pin operable for receiving a voltage to power said controller, wherein said controller determines that said light source is in a short circuit condition if said voltage decreases below a threshold when said switch is off.

22. The controller as claimed in claim 21, further comprising:

a comparator coupled to said error amplifier and operable for comparing said error signal with a sawtooth signal; and a pulse-width modulation signal generator coupled to said comparator and operable for generating said driving signal based on an output of said comparator and also based on a reset signal.

23. The controller as claimed in claim 21, wherein said controller determines that said light source is in an open circuit condition if said second signal increases above a threshold when said switch is off.

* * * * *